US006687930B1

(12) United States Patent
Eads et al.

(10) Patent No.: US 6,687,930 B1
(45) **Date of Patent: *Feb. 10, 2004**

(54) EXTERNAL FRAME ENCLOSURE BED APPARATUS

(75) Inventors: Norman B. Eads, Houston, TX (US); Barry Bearden, Houston, TX (US)

(73) Assignee: Safe-T-Care Manufacturing Co., Ltd., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/093,448

(22) Filed: Mar. 11, 2002

(51) Int. Cl.[7] ..... A47C 29/00

(52) U.S. Cl. ..... 5/414; 5/424; 5/658; 135/96; 135/121

(58) Field of Search ..... 5/414, 424, 658, 5/600, 97, 98.1; 135/96, 121, 157

(56) References Cited

U.S. PATENT DOCUMENTS 4,084,598 A * 4/1978 Rainwater ..... 135/121
4,489,451 A * 12/1984 Neely ..... 135/121
4,641,387 A 2/1987 Bondy et al.
4,729,137 A * 3/1988 Denney ..... 135/121
4,779,294 A * 10/1988 Miller ..... 135/121
5,384,925 A 1/1995 Vail
5,517,707 A * 5/1996 LaMantia ..... 5/97
5,784,732 A 7/1998 Vail
5,836,330 A * 11/1998 Franklin ..... 135/90
6,109,280 A * 8/2000 Custer ..... 135/116
6,216,291 B1 4/2001 Eads et al.
6,260,566 B1 * 7/2001 LaFave et al. ..... 135/88.01
6,450,186 B1 * 9/2002 Pearcy ..... 135/96

* cited by examiner

*Primary Examiner*—Teri Pham Luu
(74) *Attorney, Agent, or Firm*—Harrison & Egbert

(57) ABSTRACT

An enclosure bed apparatus including a frame having legs connected to an upper structure, and a canopy affixed to the frame so as to define a three dimensional space therein. The upper structure includes side bars and end bars arranged in a generally rectangular configuration. The canopy includes a pair of sleeves at opposite sides of a top thereof which respectively receive the side bars of the upper structure therein. The canopy has vertical sleeve members extending downwardly so as to receive portions of the legs therein. The canopy has a pair of horizontal sleeves extending outwardly from a top thereof suitable for receiving respective end bars therein. The frame is arranged so as to be exterior of the three dimensional space defined by the canopy.

14 Claims, 6 Drawing Sheets

EXTERNAL FRAME ENCLOSURE BED APPARATUS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to enclosure beds. More particularly, the present invention relates to enclosure beds having external frames. Additionally, the present invention relates to enclosure beds that can removably receive a hospital bed therein.

BACKGROUND OF THE INVENTION

In medical treatment situations, it is sometimes necessary to physically restrain certain patients in order to provide protection for themselves and/or others. For example, adults and children having dementia, psychiatric or mental disorders, or other kinds of physical and/or mental problems may need to be restrained. In the past, these people have been physically restrained by using ties, straps or vests. However, the use of these kinds of restraints can cause severe discomfort and can impede emergency treatment. In addition, these kinds of restraints must frequently be removed during the day for a variety of reasons, such as to allow the person to exercise his or her muscles, or to clean or feed the patient.

One alternative to using physical restraints involves the use of an enclosure bed. Typically, the enclosure bed includes a supporting framework and a knitted covering which is fitted over the sides and the top of the framework. The knitted covering is provided with zippered areas which can be readily opened and closed in order to provide access to the interior of the enclosure. Thus, the enclosure bed provides a more humane, safe and less restrictive environment for the person.

Unfortunately, a major problem with the use of such enclosure beds is the inability to move the enclosure bed after it is installed. Typically, specialized personnel must be called in so as to move the enclosure bed. In certain instances, the enclosure bed must be dismantled so that the hospital bed (on the interior of the enclosure bed) can be moved. In other circumstances, in order to move a patient from the enclosure bed to another location, the patient would have to be lifted and transferred to mobile bed. The difficulty in actually moving the enclosure bed has discouraged the use of such enclosure beds.

In the past, various U.S. patents have issued relating to such enclosure beds. For example, U.S. Pat. No. 4,641,387, issued on Feb. 10, 1987 to Bondy et al., teaches an enclosure for a bed which provides protection for patients. The enclosure is formed of a supporting framework and an associated covering provided with suitably arranged zippered areas for achieving access to the patient from the exterior of the enclosure. The frame of the enclosure bed has a rectangular structure which is designed so as to rest flatly upon a floor.

U.S. Pat. No. 5,384,925, issued on Jan. 31, 1995 to R. L. Vail, teaches an improved bed enclosure which is provided with a unique supporting structure which increases the vertical stability of the bed enclosure. The bed enclosure includes a frame having at least four upright side posts, each including an upper portion and a lower portion. The frame also includes upper frame support members interconnecting the upper portions of the side posts together and lower frame support members interconnecting the lower portions of the side posts together. The frame defines a pair of generally vertical side walls of a predetermined length and a pair of opposing end walls of a predetermined width. At least one support leg associated with each of the side walls is secured to the lower portion of the side posts and is engageable with the floor at a point spaced outwardly from the respective side wall. A bar extends in a horizontal orientation so as to rest flatly upon the floor.

U.S. Pat. No. 5,784,732, issued on Jul. 28, 1998 to R. L. Vail, describes another type of bed enclosure which is provided with a side rail which is movably mounted to the frame of the bed enclosure by a hinge assembly. The bed enclosure includes side posts having bottoms which support the enclosure directly upon the floor. The hospital bed is retained on the interior of the bed enclosure. The wheels of the hospital bed will reside independently upon the same floor upon which the bottoms of the side posts reside.

U.S. Pat. No. 6,216,291, issued on Apr. 17, 2001 to the present inventors, describes an enclosure bed apparatus having a bed with a mattress supported on a bed frame, and wheels rotatably supported on a bottom thereof so as to rollably support the mattress on a floor. An enclosure frame extends over the mattress and has a lower portion affixed to the bed frame such that the bottoms of the legs are supported at a distance above the floor. An enclosure is affixed to enclosure frame so as to extend over and around the mattress. A clamp is used to connect the lower portion of the enclosure frame to the bed frame. The enclosure has a top and a plurality of side walls and a bottom. The bottom of the enclosure is interposed between the mattress and the bed frame. The top of the enclosure extends over and around the upper structure of the enclosure frame.

It is an object of the present invention to provide an enclosure bed having an external frame.

It is another object of the present invention to provide an enclosure bed that can be easily assembled and disassembled.

It is another object of the present invention to provide an enclosure bed which facilitates easy cleaning and replacement of the canopy.

It is an object of the present invention to provide an enclosure bed which does not require specialized labor for movement or assembly.

It is a further object of the present invention to provide an enclosure bed which is adaptable to a wide variety of existing hospital beds.

These and other objects and advantages of the present invention will become apparent from a reading of the attached specification and appended claims.

BRIEF SUMMARY OF THE INVENTION

The present invention is an enclosure bed apparatus comprising legs extending downwardly from an upper structure, and a canopy affixed to the frame so as to define a three dimensional space therein. The upper structure of the frame has side bars and end bars arranged in a generally rectangular configuration. The frame also has a lower structure connected to the legs and also has a generally rectangular configuration with cross members affixed respectively to the legs at opposite ends of the frame and having longitudinal members affixed respectively to the cross members and extending therebetween in a generally parallel relationship.

The canopy of the present invention has a pair of sleeves at opposite sides of a top thereof. This pair of sleeves respectively receives the side bars of the upper structure therein. The canopy also has vertical sleeve members extending downwardly at the corners thereof. The vertical sleeve member serves to receive at least a portion of the respective legs therein. The canopy also has a pair of horizontal sleeve members extending outwardly from respective end edges of a top thereof. The pair of horizontal sleeve serves to receive respective end bars of the upper structure therein.

Each of the vertical sleeve members includes a first vertical section having an edge affixed with a canopy and a second vertical section having an edge affixed to the canopy. The vertical sleeve member has a strip of hook-and-loop material extending along an opposite edge of the first vertical section and has a complementary strip of hook-and-loop material extending along an opposite edge of the second vertical section. The strips of hook-and-loop material are removably affixed to each other so as to extending around the legs's. Similarly, the pair of horizontal sleeves has a similar structure with hook-and-loop material extending around the edges so as to allow the horizontal sleeves to be properly affixed around the end bars of the upper structure of the frame.

Each of the end bars of the upper structure comprises a bar extending horizontally between a respective pair of the legs, a first insert element at one end of the bar received by a respective side bar within a respective sleeve, a second insert element at the same end of the bar and received by one of the pair of legs within the vertical sleeve members, a third insert element at an opposite end of the bar and received by another side bar within another interior of the sleeve, and a fourth insert element at the opposite end of the bar and received by another of the pair of legs within another vertical sleeve member. The second insert element extends transverse to the first insert element. Similarly, the fourth insert element extends transverse to the third insert element.

In the present invention, the frame has a plurality of wheels affixed to a bottom of the lower structure so as to allow the frame to be rolled along the surface.

The canopy includes a first side panel, a second side panel, a first end panel connected to an end of each of the first and second side panels, a second end panel connected to an opposite end of each of the first and second side panels, a top panel extending across the upper structure and connected to a top edge of each of the first and second side panels and a bottom panel connected to a bottom edge of each of the first and second side panels. At least one of the panels has a netting affixed hereto. This netting is in zippered completely removable relationship within the panel.

In the present invention, there is provided a bed with a mattress supported on a bed frame. The bed frame has wheels rotatably connected at a bottom thereof so as to rollably support the mattress upon a floor. The bed frame is retained within the enclosure bed frame. The bottom panel is interposed between the mattress and the bed frame.

DETAILED DESCRIPTION OF THE INVENTION

Figure 1:
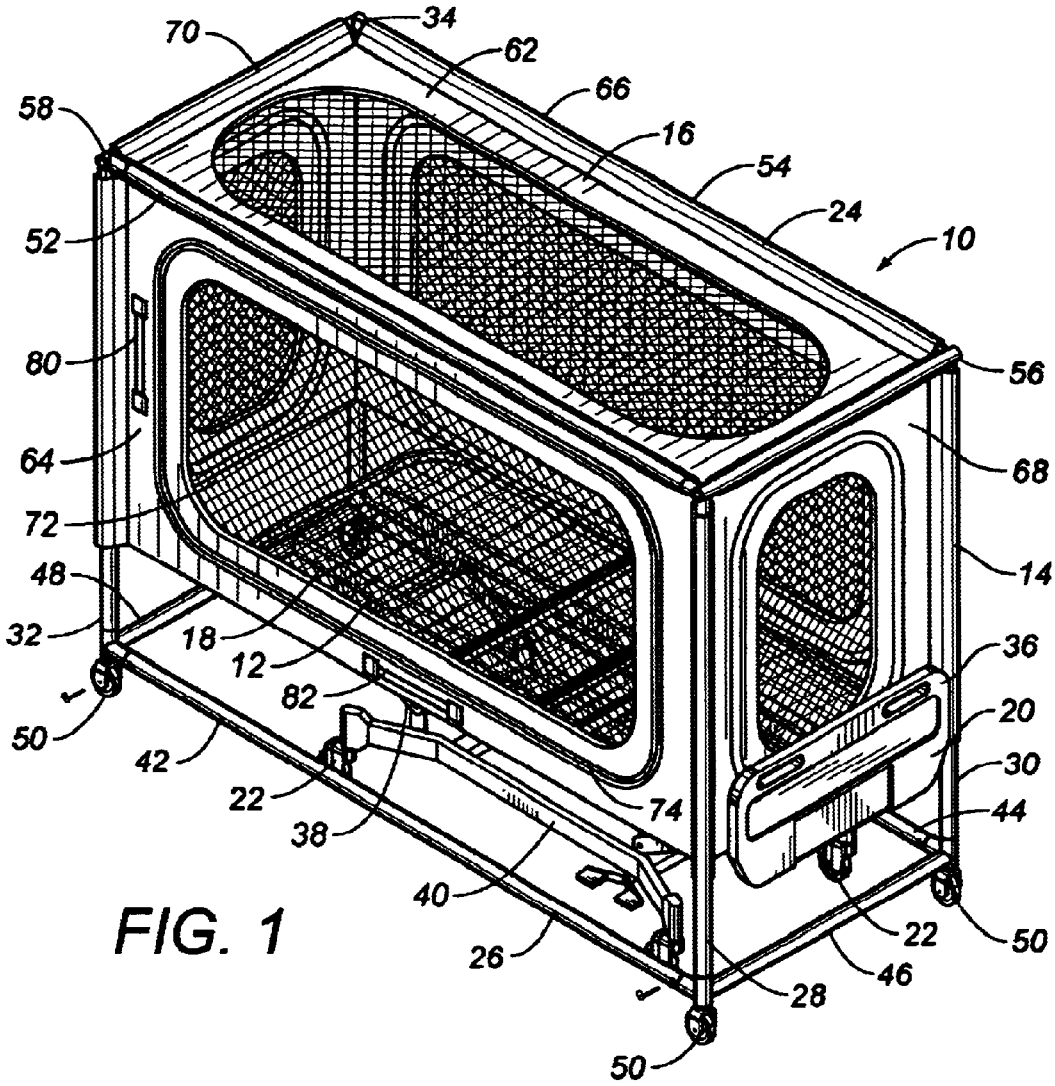
FIG. 1 is a perspective view of the enclosure bed apparatus in accordance with the teachings of the present invention.

Referring to FIG. 1, there is shown at the enclosure bed apparatus 10 in accordance with the preferred embodiment of the present invention. The enclosure bed apparatus 10 includes a hospital bed 12, an enclosure frame 14 and a canopy 16. The hospital bed 12 includes a mattress 18 supported on a bed frame 20. Wheels 22 are rotatably mounted to a bottom of the bed frame 20 so as to rollably support the mattress 18 on a floor. The enclosure frame 14 extends over and around the mattress 18. The enclosure frame 14 has an upper structure 24 and a lower structure 26 with a plurality of legs 28, 30, 32 and 34 connected to the upper structure 24 and the lower structure 26. The canopy 16 is affixed to the enclosure frame 14 so as to extend over and around the mattress 18.

As shown in FIG. 1, the bed 12 is a hospital bed of a standard configuration. The hospital bed 12 is commonly known as a Trendelenburg bed. The mattress 18 is typically placed upon a flat surface between the base board 36 and a head board of the bed. Pivotal linkages 38 are connected to the upper frame of the hospital bed 12 so as to manipulate and adjust the position of the patient of the bed 12. Suitable pivotal movement of the linkages 38 can cause the base board 36 and the head board to move upwardly and downwardly. Linkages are pivotably connected to the bottom frame 40. Wheels 22 are rotatably connected to the bottom frame 40.

As can be seen in FIG. 1, the lower structure 26 of the enclosure frame 14 includes a longitudinal member 42 extending between legs 28 and 32. Similarly, another longitudinal member 44 will extend between legs 30 and 34. A cross member 46 extends between legs 28 and 30. Another cross member 48 extends between legs 32 and 34. Wheels 50 are connected to the bottom of the lower structure 26 so as to allow the enclosure frame 14 to be rollable along with the rolling movement of the hospital bed 12.

The enclosure frame 14 also has upper structure 24. The upper structure 24 includes side bars 52 and 54 and end bars 56 and 58. The side bars 52 and 54 and the end bars 56 and 58 are arranged in a generally rectangular configuration. The side bar 52 will extend between legs 28 and 32. The side bar 54 will extend between legs 30 and 34. The end bar 56 extends between legs 28 and 30. The end bar 58 extends between legs 32 and 34.

The enclosure 16 has a top 62, side walls 64 and 66, end walls 68 and 70 and a bottom (not shown). The top 62, the side walls 64 and 66 and the end walls 68 and 70 are securely interconnected together. In normal use, the bottom will be interposed between the mattress 18 and the upper frame of the hospital bed 12. As will be described hereinafter, suitable sleeves are provided so as to secure the enclosure 16 to the respective side bars 52 and 54, to the end bars 56 and 58, and to the legs 28, 30, 32 and 34.

As can be seen in FIG. 1, the side wall 64 includes a netting 72 which is secured by a zipper 74 to the remainder of the side wall 64. Zipper 74 is positioned around the side wall 64 so as to allow for the easy attachment and removal of the netting 72, as desired. In particular, the zipper is a "one-track" zipper which will allow the netting 72 to be removed from the side panel 64. For example, if it is necessary to completely replace, to wash or to repair the netting 72, the zipper 74 can be simply unzipped, around its periphery, so as to allow for the easy removal of the netting 72. The side panel 66 has a similar netting area. The end panels 68 and 70 also include similar netting areas. The top 62 further includes a suitable netting area, similar to that of netting 72 of side panel 64.

In FIG. 1, it can be seen that zippered slits 80 and 82 are formed in the side wall 64. These zippered slits 80 and 82 can be suitably manipulated so as to allow access to the three-dimensional interior of the enclosure 16. As such, if necessary, IV bags can be connected to a patient on the interior of the enclosure 16 through the zippered slits 80 and 82.

Figure 2:
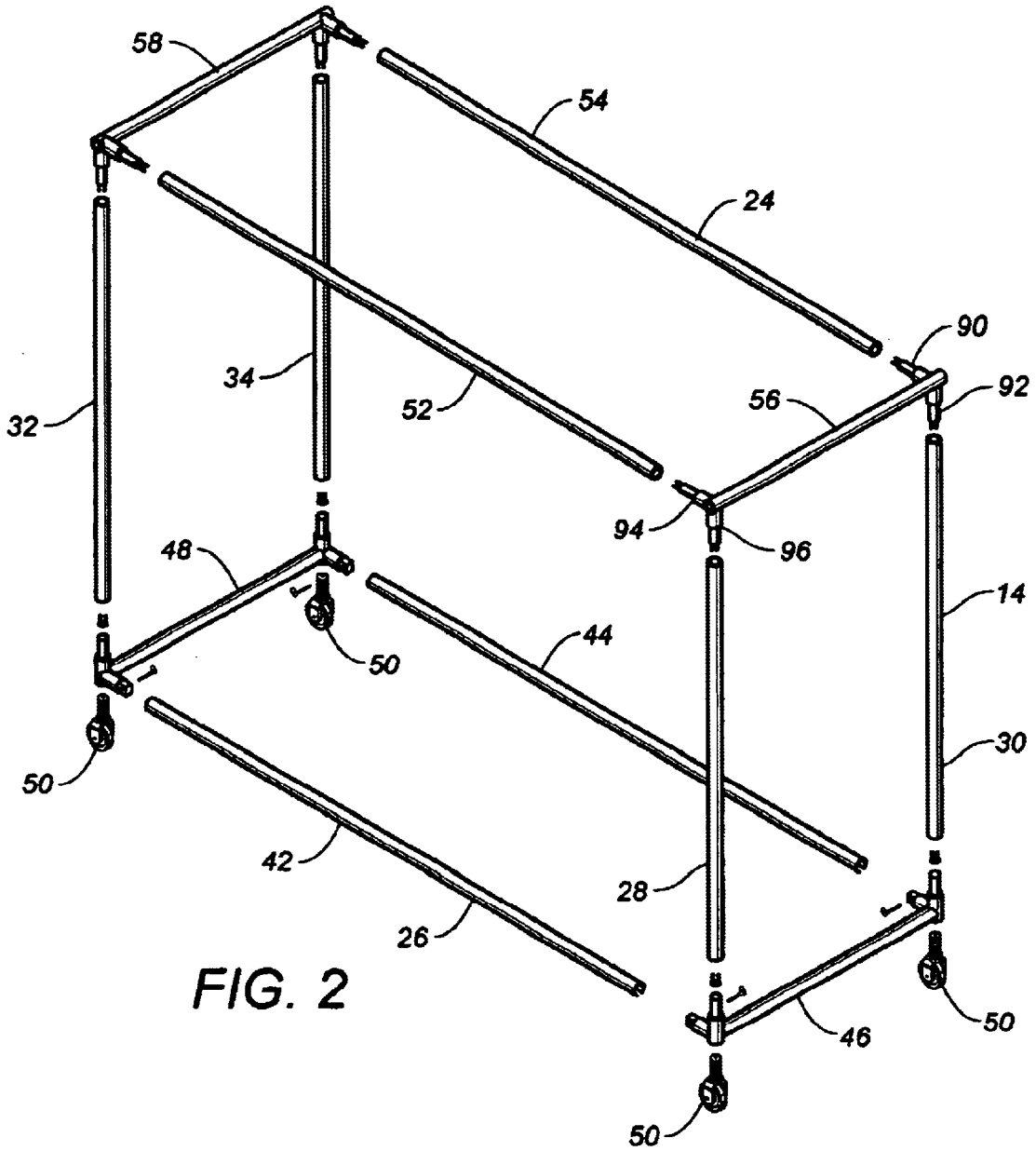
FIG. 2 is a perspective view of an isolated frame as used with the enclosure bed apparatus of the present invention.

FIG. 2 shows an isolated view of the frame 14 as used with the enclosure bed apparatus 10 of the present invention. The frame 14 includes legs 28, 30, 32 and 34 which extend vertical downwardly from the upper structure 24. The upper structure 24 includes side bars 52 and 54 and end bars 56 and 58. The lower structure 26 also includes longitudinal members 42 and 44 and cross members 46 and 48. Wheels 50 are positioned below the lower structure 26 so as to rollably support the frame 14 on a floor or other surface.

The present invention includes certain elements which facilitate the construction of the frame 14. In particular, the end bar 56 has a first insert element 90 and a second insert element 92 at one end. A third insert element 94 and a fourth insert element 96 are located at the opposite end of bar 56. Insert element 90 will be received by the open end of the tube forming the side bar 54. Insert element 96 can be inserted into the open end of the leg 28. Insert element 94 can be inserted into the open end of the side bar 52.

A similar structure will occur with respect to the end bar 58. Also, a similar arrangement appears with the cross members 46 and 48 at the lower structure 26. Suitable pins can be inserted into the joined areas of the respective elements of the frame structure 14 so as to securely hold the frame structure together. If necessary, styrofoam tubes can be place around the various tubes and bars for a cushioning effect.

Figure 3:
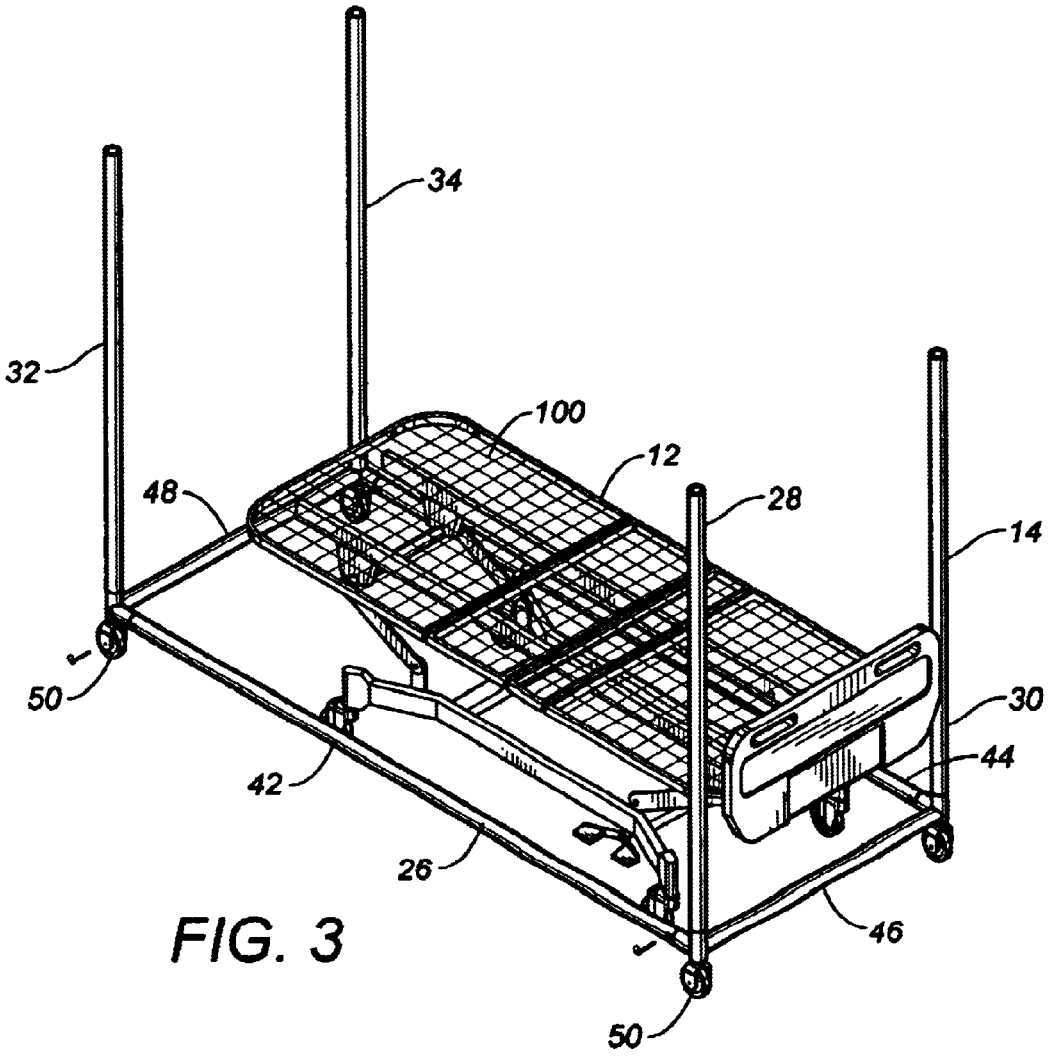
FIG. 3 shows the lower structure and the legs of the frame in combination with a hospital bed.

FIG. 3 shows the hospital bed 12 as placed within the frame 14 of the present invention. In FIG. 3, the hospital bed 12 has a flat surface 100 thereon. During assembly, the bottom panel of the enclosure 16 will reside against the flat surface 100. The mattress 18 can then be placed upon the bottom panel of the enclosure 16.

FIG. 3, the legs 28, 30, 32 and 34 are illustrated as extending upwardly from the corners of the lower structure 26. The lower structure 26 has a rectangular configuration formed by longitudinal members 42 and 44 and cross members 46 and 48. The hospital bed 12 is placed within the interior of the lower structure 26. As such, during movement of the enclosure bed invention, the bed frame 12 will be directed along with the movement of the enclosure frame 14.

Figure 4:
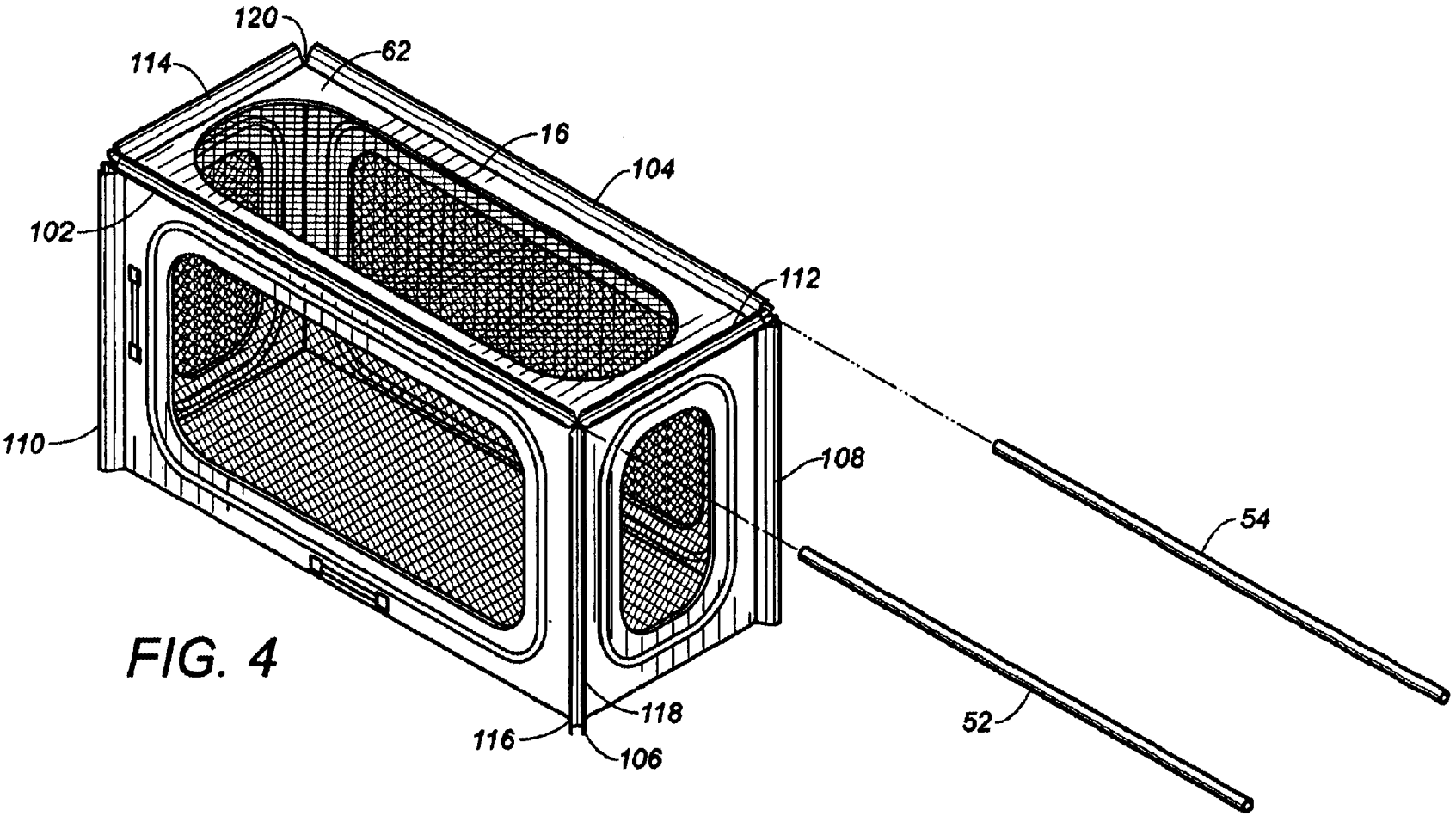
FIG. 4 is a perspective view showing the canopy as used with the enclosure bed of the present invention.

FIG. 4 shows the particular structure of the enclosure 16. In particular, in FIG. 4, it can be seen that a pair of sleeves 102 and 104 extend along the sides of the top panel 62 of enclosure 16. Sleeves 102 and 104 are particularly configured so as to receive the side bars 52 and 54 therein. Sleeves 102 and 104 are suitably connected to the edges of the top panel 62 so as to extend outwardly therefrom. As a result of the connection of the side bars 52 and 54 within the sleeves 102 and 104, the side bars 52 and 54 will reside on the exterior of the enclosure 16. As such, the sleeves 102 and 104 will provide a cushioning effect to a patient interior of the enclosure 16.

Additionally in FIG. 4, it can be seen that several vertical sleeve members 106, 108 and 110 extend vertically downwardly along the corners of the enclosure 16. Each of the vertical sleeve members 106, 108 and 110 are configured so as to receive a respective leg of the frame 14 therein. Also, in FIG. 4, it can be seen that horizontal sleeve members 112 and 114 extend across the end edges of the top panel 62. Sleeve members 112 and 114 are particularly configured so as to receive the end bars 56 and 58 of the frame.

With respect to the vertical sleeve members 106, 108 and 110, along with the horizontal sleeve members 112 and 114, each of the respective sleeve members utilizes hook-and-loop VELCRO (TM) material so as to allow the respective sleeve members to be removably attached to the frame. In particular, for example, with respect to vertical sleeve member 106, vertical member 106 is formed of a first vertical section 116 and a second vertical section 118. One edge of vertical section 116 is secured to the corners of the enclosure 16. Similarly, an edge of the vertical section 118 is secured in a similar location to the corner of the enclosure 16. The opposite edges of each of the vertical sections 116 and 118 will include complementary hook-and-loop material strips. As a result, when a leg is inserted into the vertical sleeve member 106, the edges can be closed upon one another so as to securely be affixed around the leg member. This structure will also occur relative to the vertical sleeve members 108 and 110 and the horizontal sleeve members 112 and 114. It is to be noted that another vertical sleeve member will occur at the corner 120 of enclosure 16 (not shown).

Figure 5:
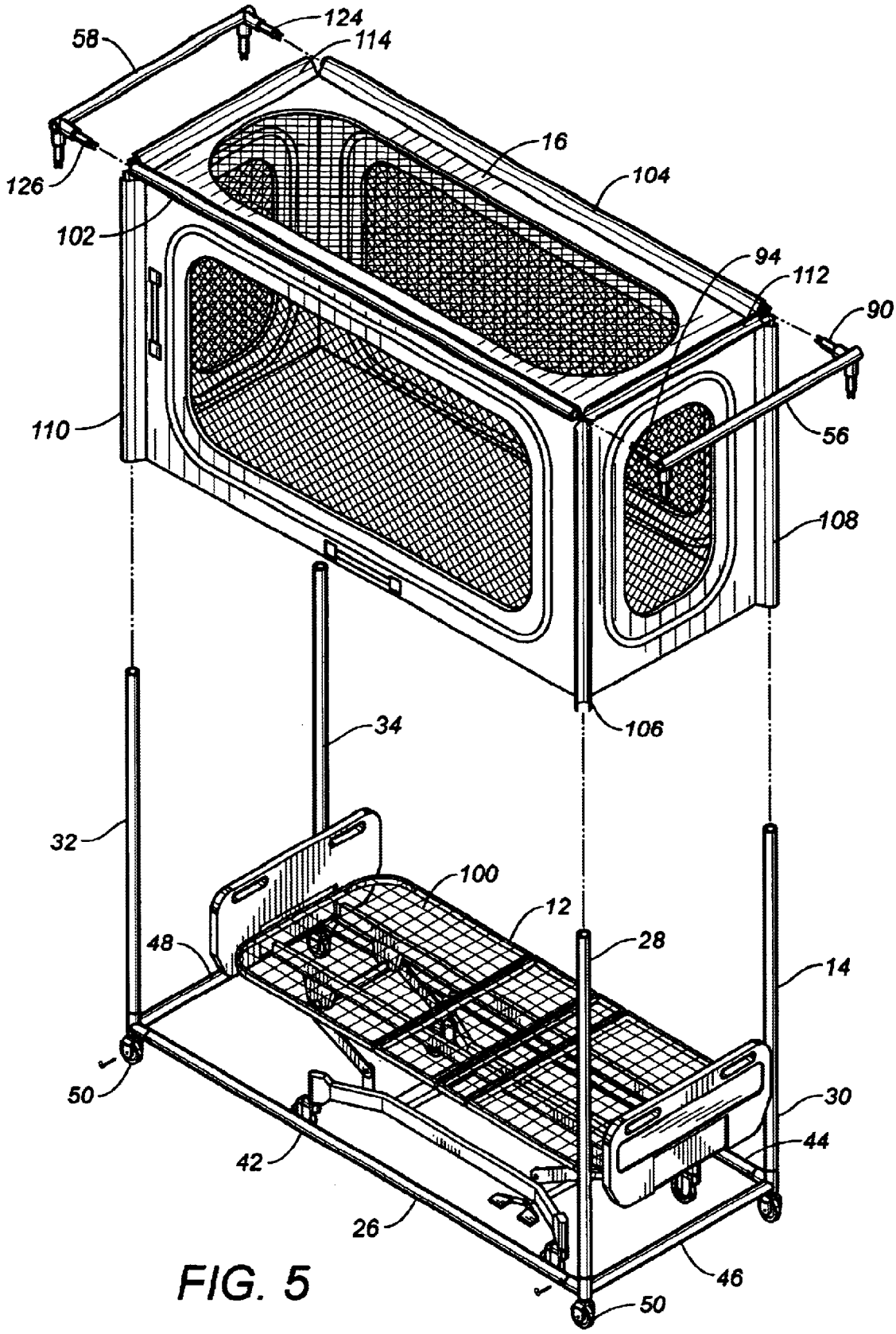
FIG. 5 is an exploded perspective view showing the assembly of the canopy and frame around the hospital bed.

In FIG. 5, the assembly of the enclosure be apparatus 10 of the present invention is further indicated. As can be seen, the first end bar 56 and the second end bar 58 are moved toward the side bars that are retained within sleeve members 102 and 104. As can be seen, the first insert element 90 will be inserted into the opening of the side bar 54 within the sleeve 104. Similarly, the insert element 94 will also be inserted into the open end of the side bar 52 located within sleeve 102. The second end bar 58 has an insert element 124 which will be inserted into the opposite end of the side bar 54 within the sleeve 104. The second end bar 58 also has another insert element 126 which will be inserted into the open end of the side bar 52 located within the sleeve 102. The enclosure 16 is illustrated in FIG. 5 as located above the hospital bed 12 and over the lower structure 26 of the frame 14. Each of the vertical sleeve members 106, 108 and 110 is illustrated as being in an open position. Similarly, the horizontal sleeve members 112 and 114 are also illustrated as being in an open position.

Figure 6:
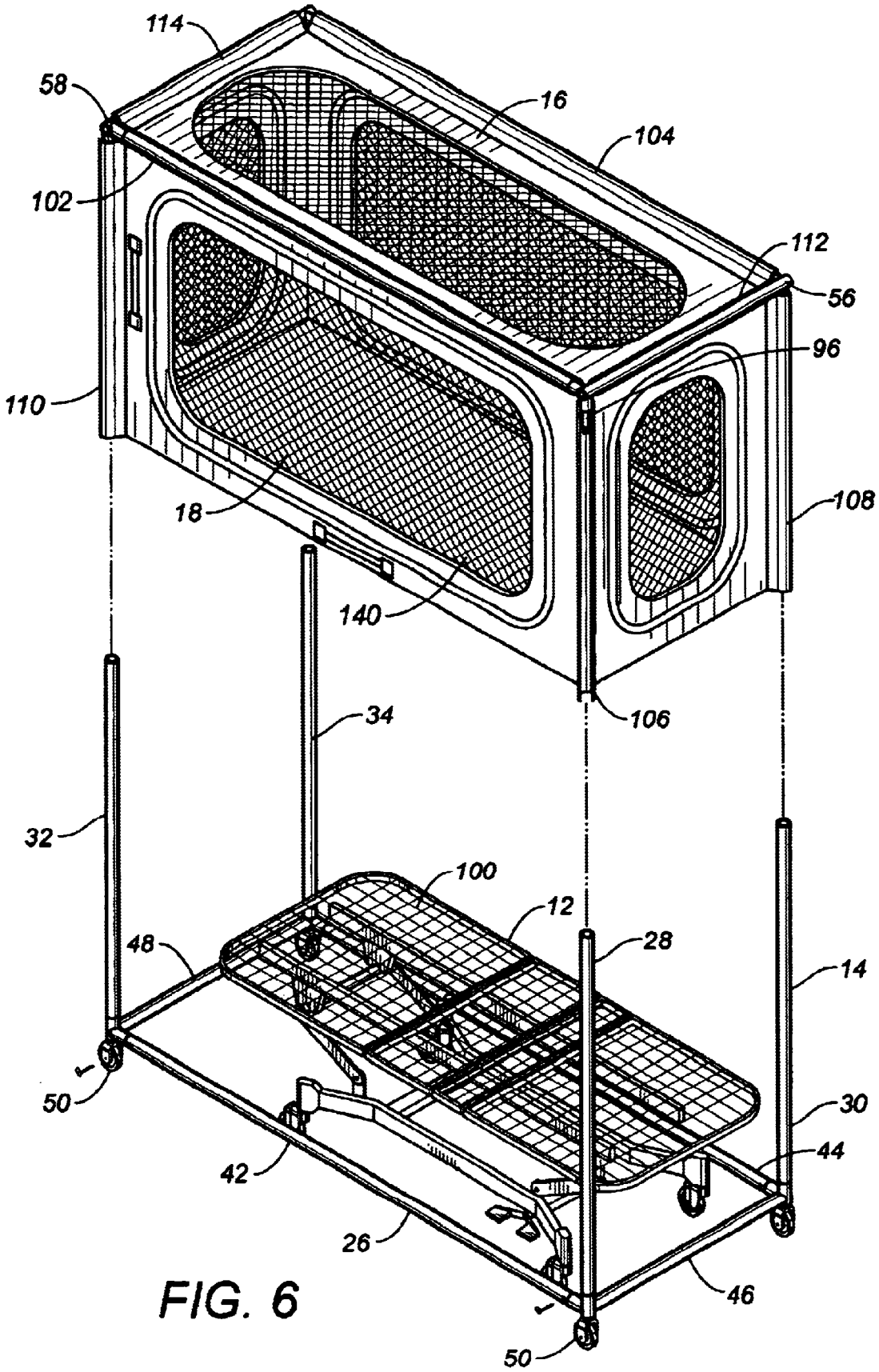
FIG. 6 is a perspective view showing a further step of the assembly of the canopy with the frame and the hospital bed.

In FIG. 6, the end bar 56 is shown as inserted within the sleeves 102 and 104. Similarly, the end bar 58 is shown as inserted within the sleeves 102 and 104. The horizontal sleeve 112 is illustrated as closed around the end bar 56. Similarly, the horizontal sleeve member 114 is illustrated as closed around the end bar 58. As a result, the enclosure 16 is firmly retained in position.

The enclosure 16 is then lowered so that the insert element 92 of the end bar 56 will be placed into the open end of leg 30. Similarly, the insert element 96 of end bar 56 will be inserted into the open end of leg 28. A similar arrangement will occur with respect to the insert elements associated with the end bar 58. When the enclosure 16 is suitably lowered over the hospital bed 12, the vertical sleeve members 106, 108 and 110 can then be closed around the respective legs 28, 30 and 32. As a result, the enclosure 16 will be firmly and rigidly retained around the frame 14. A mattress 18 can then be placed through the opening defined by netting 18 so as to reside upon the bottom panel 140 of the enclosure 16. The enclosure bed apparatus 10 is then in a proper configuration for use.

By using the frame 14 as external to that of the enclosure 16, the assembly of the enclosure bed apparatus is facilitated. All of the connections between the enclosure 16 and the frame 14 can be carried out relatively easily in a one-person operation. The use of the sleeves can provide a cushioning effect for any patient retained within the enclosure 16. The enclosure 16 is suitably by united with the hospital bed 12 so that the rolling movement of the frame 14 will also move the hospital bed 12 in a convenient and easy manner.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We claim:

1. An enclosure bed apparatus comprising:

a frame having legs and an upper structure connected to said legs, said upper structure having side bars and end bars arranged in a generally rectangular configuration, said legs extending downwardly from said upper structure; and a canopy affixed to said frame so as to define a three-dimensional space therein, said canopy having a pair of sleeves at opposite sides of a top thereof, said pair of sleeves respectively receiving said side bars of said upper structure therein, each of said end bars of said upper structure comprising:

a bar extending horizontally between a respective pair of legs;

a first insert element at one end of said bar received by a respective side bar within a respective sleeve;

a second insert element at said one end of said bar, said second element received by one of said pair of legs within said vertical sleeve member;

a third insert element at an opposite end of said bar, said third insert element received by another respective side bar within a respective sleeve; and a fourth insert element at said opposite end of said bar, said fourth insert element received by another of said pair of legs within said vertical sleeve member.

2. The apparatus of claim 1, said canopy having vertical sleeve members extending downwardly from at east two corners thereof, said sleeve members receiving a portion of respective legs therein.

3. The apparatus of claim 2, said canopy having four vertical sleeve members affixed at each corner thereof, said legs being received by said respective sleeve members.

4. The apparatus of claim 3, each of said vertical sleeve members comprising a first vertical section having an edge affixed to said canopy and a second vertical section having an edge affixed to said canopy, said vertical sleeve member having a strip of hook-and-loop material extending along an opposite edge of said first vertical section, said vertical sleeve member having a complementary strip of hook-and-loop material extending along an opposite edge of said second vertical section, said strip of hook-and-loop material being removably affixed to said complementary strip of hook-and-loop material.

5. The apparatus of claim 1, said canopy comprising:

a first side panel;

a second side panel;

a first end panel connected to an end of each of said first and second side panels;

a second end panel connected to an opposite end of said first and second side panels;

a top panel extending across said upper structure and connected to a top edge of each of said first and second side panels; and a bottom panel connected to a bottom edge of each of said first and second side panels.

6. The apparatus of claim 5, at least one of the panels having a netting affixed thereto.

7. The apparatus of claim 6, said netting being in zippered completely removable relationship within the panel.

8. The apparatus of claim 5, Further comprising:

a bed having a mattress supported on a bed frame, said bed frame positioned within said frame, said bottom panel interposed between said mattress and said bed frame.

9. The apparatus of claim 1, further comprising:

a bed having a mattress supported on a bed frame, said bed frame having wheels rotatably connected at a bottom thereof so as to rollably support said mattress upon a floor, said bed frame positioned interior of said frame.

10. The apparatus of claim 1, said canopy having a pair of horizontal sleeve members extending outwardly from respective end edges thereof, said pair of horizontal sleeves receiving respective end bars of said structure therein.

11. The apparatus of claim 10, each of said pair of horizontal sleeves comprising a first horizontal section having an edge affixed to said canopy and a second horizontal section having an edge affixed to said canopy, said horizontal sleeve member having a strip of hook-and-loop material extending along an opposite edge of said first horizontal section, said horizontal sleeve member having a complementary strip of hook-and-loop material extending along an opposite edge of said second horizontal section, said strip of hook-and-loop material being removably affixed to said complementary strip of hook-and-loop material.

12. An enclosure bed apparatus comprising:

a frame having legs and an upper structure connected to said legs, said upper structure having side bars and end bars arranged in a generally rectangular configuration, said legs extending downwardly from said upper structure; and a canopy affixed to said frame so as to define a three-dimensional space therein, said canopy having a pair of sleeves at opposite sides of a top thereof, said pair of sleeves, respectively receiving said side bars of said upper structure therein said canopy having vertical sleeve members extending downwardly from at least two corners thereof, said sleeve members receiving a portion of respective legs therein, each of said end bars of said upper structure comprising:

a bar extending horizontally between a respective pair of legs;

a first insert element at one end of said bar received by a respective side bar within a respective sleeve;

a second insert element at said one end of said bar, said second insert element received by one of said pair of legs within said vertical sleeve member;

a third insert element at an opposite end of said bar, said third insert element received by another respective side bar within a respective sleeve; and a fourth insert element at said opposite end of said bar, said fourth insert element received by another of said pair of legs within said vertical sleeve member.

13. The apparatus of claim 12, said second insert element extending transverse to said first insert element, said fourth insert element extending transverse to said third insert element.

14. An enclosure bed apparatus comprising:

a frame having legs and an upper structure connected to said legs, said upper structure having side bars and end bars arranged in a generally rectangular configuration, said legs extending downwardly from said upper structure; and a canopy affixed to said frame so as to define a three-dimensional space therein, said canopy having a pair of sleeves at opposite sides of a top thereof, said pair of sleeves respectively receiving said side bars of said upper structure therein, said frame having a lower structure having cross members affixed respectively to said legs at opposite ends of said frame, said lower structure having longitudinal members affixed respectively to said cross members and extending therebetween in generally parallel relationship, said frame having a plurality of wheels affixed to a bottom of said lower structure so as to allow said frame to be rolled along a surface.

* * * * *